US011889934B2

(12) United States Patent
Jadhav

(10) Patent No.: US 11,889,934 B2
(45) Date of Patent: Feb. 6, 2024

(54) SYSTEM FOR FRAMING AND DISPLAYING PHOTOGRAPHS

(71) Applicant: Kunal Jadhav, Pune (IN)

(72) Inventor: Kunal Jadhav, Pune (IN)

( * ) Notice: Subject to any disclaimer, the term of this patent is extended or adjusted under 35 U.S.C. 154(b) by 0 days.

(21) Appl. No.: 17/917,515

(22) PCT Filed: Sep. 22, 2020

(86) PCT No.: PCT/IN2020/050809
§ 371 (c)(1),
(2) Date: Oct. 6, 2022

(87) PCT Pub. No.: WO2021/229593
PCT Pub. Date: Nov. 18, 2021

(65) Prior Publication Data

US 2023/0148769 A1 May 18, 2023

(30) Foreign Application Priority Data

May 14, 2020 (IN) ..... 202021020256

(51) Int. Cl.

| | |
|---|---|
| ***A47G 1/24*** | (2006.01) |
| ***A47G 1/16*** | (2006.01) |
| ***A47G 1/06*** | (2006.01) |
| ***A47G 1/17*** | (2006.01) |

(52) U.S. Cl.
CPC ..... *A47G 1/1606* (2013.01); *A47G 1/06* (2013.01); *A47G 1/17* (2013.01); *A47G 1/24* (2013.01); *A47G 2001/0672* (2013.01)

(58) Field of Classification Search
CPC ..... A47G 1/1606; A47G 1/06; A47G 1/17; A47G 1/24; A47G 2001/0672
See application file for complete search history.

(56) References Cited

U.S. PATENT DOCUMENTS 3,885,336 A 5/1975 Olsen
10,550,580 B1 * 2/2020 Longo ..... E04F 13/0882
(Continued)

FOREIGN PATENT DOCUMENTS

WO WO-2009/018530 A1 2/2009

OTHER PUBLICATIONS

International Search Report with Written Opinion for International Patent Application No. PCT/IN2020/050809, dated Nov. 6, 2020.

*Primary Examiner* — Cassandra Davis
(74) *Attorney, Agent, or Firm* — Foley & Lardner LLP

(57) ABSTRACT

The present disclosure relates to a system (100) for framing and displaying photographs comprising at least one frame backing (10) for receiving at least one photograph; at least one fastening mechanism (18) comprising at least one couple fastener (18) for affixing the frame backing (10) to the mounting surface (12); at least one marking tool (20) adapted to create at least one marking on the mounting surface (12); and at least one frame bracket (22) adapted to reversibly plug into the side walls of said frame backing (10), wherein the number of apertures and the number of receptacles on the frame backing exactly match the number of couple fasteners. The system further comprises at least one positioning tool (24) and at least one sticky marker (26).

12 Claims, 4 Drawing Sheets

(56) References Cited

U.S. PATENT DOCUMENTS

| | | | | |
|---|---|---|---|---|
| 2014/0061409 | A1* | 3/2014 | Mayhew, Jr. | F16M 13/02<br>248/206.5 |
| 2016/0073796 | A1* | 3/2016 | Nesbitt | G09F 7/04<br>40/711 |

* cited by examiner

SYSTEM FOR FRAMING AND DISPLAYING PHOTOGRAPHS

The present application takes priority from the previously filed Provisional application number 202021020256 titled "SYSTEM AND METHOD FOR FRAMING AND DISPLAY OF PHOTOGRAPHS" dated 14 May 2020.

FIELD

The present disclosure relates to photograph framing and display.

BACKGROUND

Traditionally photographs are hung on walls using hammers and nuts, a primitive process which may not be aesthetically appealing; not to mention detrimental to the surface on which they are mounted, specially if the location of display is temporary. If multiple photographs of varied sizes are to be displayed in a pattern, the process becomes tedious and time and labour intensive, often requiring the involvement of multiple people for exact measurements, positioning and the like. In spite of the afore-stated, there is plenty of scope for human errors; which may jeopardize the final photograph display. The consequent rework proves detrimental to the wall paint; not to mention necessitates the involvement of professional help to bring in accuracy, resulting in increased costs.

Use of hook and loop tapes have been described in the prior art for affixing frames on walls without employing nuts; however, said tapes are unable to hold traditional frames for long periods due to their heavy weights.

The inventor of the present disclosure provides a system and a kit for framing and displaying photographs which mitigates the disadvantages of the prior art.

OBJECTS

It is an object of the present disclosure to provide a system for framing and displaying photographs.

It is another object of the present disclosure to provide a system for framing and displaying photographs which is cost and time efficient.

It is yet another object of the present disclosure to provide a system for framing and displaying photographs which reduces the dependability on skilled labour.

It is still another object of the present disclosure to provide a system for framing and displaying photographs with reduced chances for human error.

It is yet another object of the present disclosure to provide a system for framing and displaying photographs which reduces the damage to mounting surfaces.

It is still another object of the present disclosure to provide a system for framing and displaying photographs which is usable across multifarious frame shapes, sizes and weights.

It is yet another object of the present disclosure to provide a system for framing and displaying photographs which enables the user to put up the photograph(s) and frame(s) at the exact desired location.

It is still another object of the present disclosure to provide a kit for framing and displaying photographs.

SUMMARY

The present disclosure provides a system for framing and displaying photographs comprising at least one frame backing having a front face and a back face wherein said front face is adapted to receive at least one photograph and said back face is adapted to be affixed to at least one mounting surface; said frame backing comprising at least one aperture and at least one receptacle, wherein said aperture is concentric to said receptacle; at least one fastening mechanism for affixing said frame backing to said mounting surface; said fastening mechanism comprising at least one couple fastener, wherein a first member of the couple fastener is adapted to be reversibly affixed to said mounting surface and a second member of the couple fastener is adapted to be reversibly affixed to the back face of the frame backing into said receptacle and wherein said first and second member of the couple fastener comprises at least one aperture that is co-axial to the aperture(s) on the frame backing; at least one marking tool adapted to pass through the apertures on the frame backing and the couple fasteners to create at least one marking on the mounting surface; and at least one frame bracket adapted to reversibly plug into the side walls of said frame backing, wherein the number of apertures and the number of receptacles on the frame backing exactly match the number of couple fasteners. The system further comprises at least one positioning tool adapted to enable a user to efficiently stick photographs on the frame backing and to align multiple frame backings together and at least one sticky marker adapted to temporarily mark the exact position of the frame backing on the mounting surface. The present disclosure also provides at least one kit for framing and displaying photographs.

BRIEF DESCRIPTION OF THE ACCOMPANYING DRAWINGS

The present disclosure is illustrated in the accompanying non-limiting drawings, throughout which like reference letters indicate corresponding parts in the various figures.

DESCRIPTION

Figure 1:
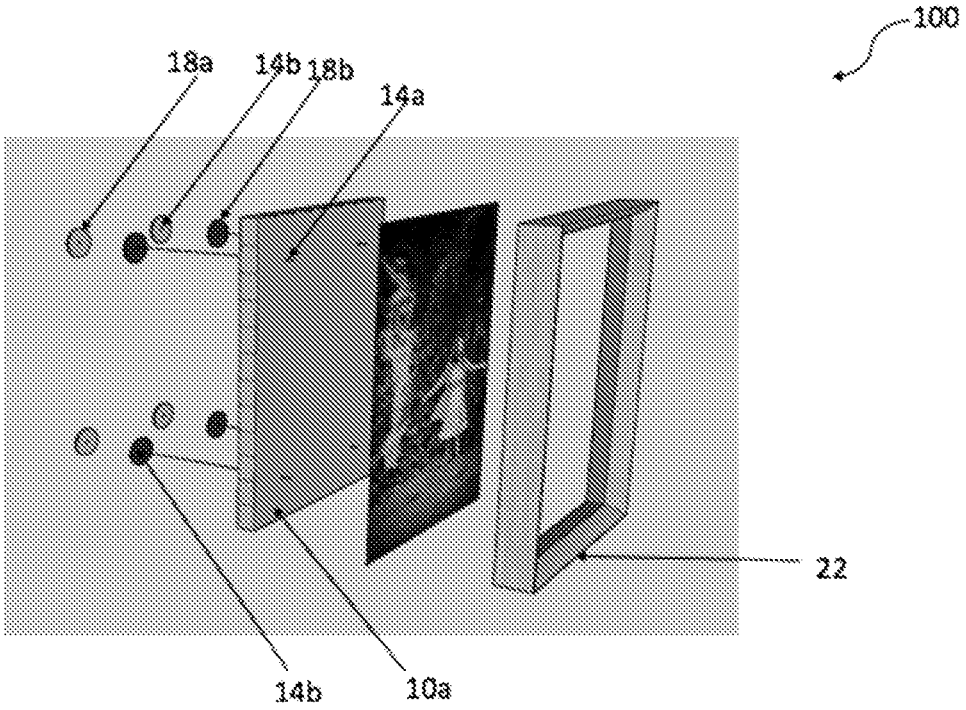
FIG. 1 illustrates a non-limiting embodiment of the front view of the system (100) of the present disclosure.
Figure 2:
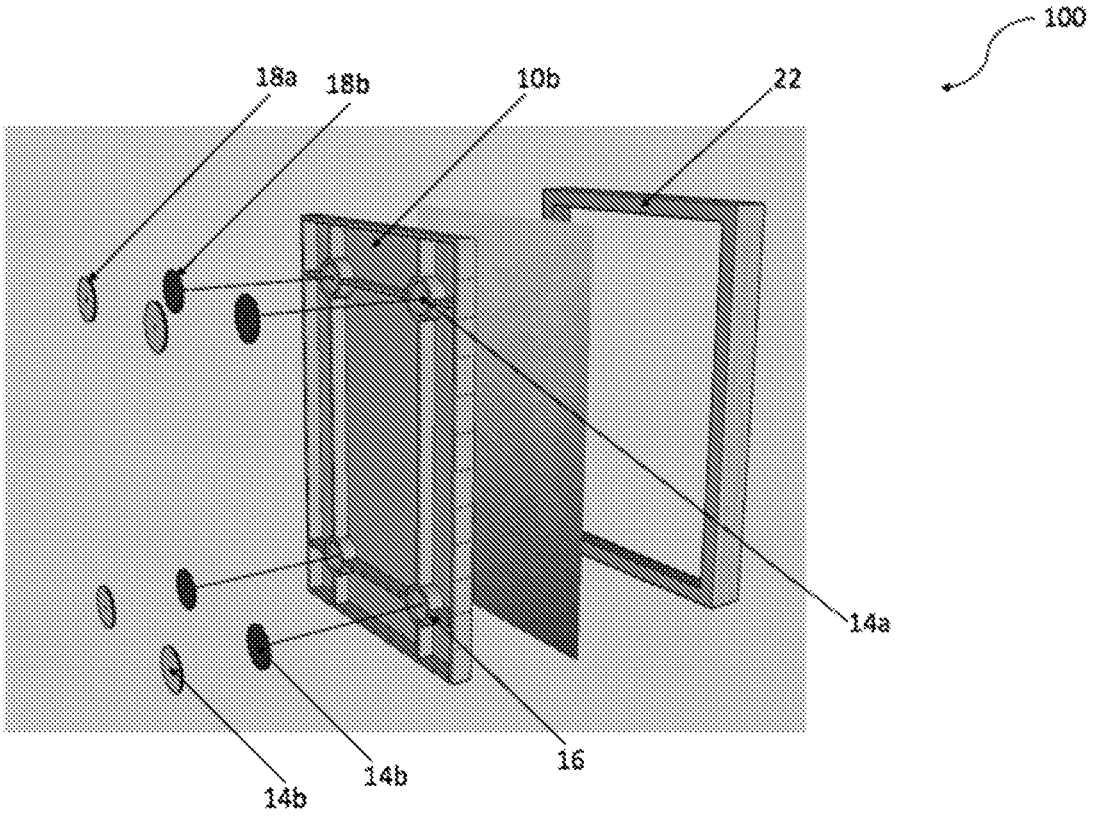
FIG. 2 illustrates a non-limiting embodiment of the back view of the system (100) of the present disclosure.

The present disclosure relates to a system (100) for framing and displaying photographs. The system (100) comprises at least one frame backing (10), at least one fastening mechanism (18), at least one marking tool (20) and at least one frame bracket (22).

The frame backing (10) of the present disclosure has a front face (10*a*) and a back (10*b*). The front face (10*a*) is adapted to receive at least one photograph and the back face (10*b*) is adapted to be affixed to at least one mounting surface (12). The front face (10*a*) comprises at least one adhesive element to facilitate reversible attachment of at least one photograph thereon. The adhesive element used herein can be any adhesive known in the art for similar purposes. In one embodiment, the adhesive element is covered with a backing sheet which can be peeled off when the user intends to paste a photograph on it. In another embodiment, the adhesive element is a two-way tape. In one embodiment, the frame backing (10) is a one-piece plastic moulded flat structure. The thickness of the frame backing (10) is variable. The frame backing (10) is of at least one size selected from the group consisting of 8"×12", 6"×6", 8"×8", 6"×8", 8"×10", 10"×12" and 12"×18". The frame backing (10) is of at least one shape selected from the group consisting of circular, oval, ellipsoid, triangular, polygonal, heart, cross, arrow and crescent. The frame backing (10) of the present disclosure comprises at least one aperture (14*a*) and at least one receptacle (16), wherein the aperture (14*a*) is concentric to the receptacle (16). The shape of the receptacle (16) is variable. The number of apertures (14*a*) on the frame backing (10) depend on the size and shape of the frame backing (10). For instance, when the frame backing (10) is large, more number of apertures (14*a*) and consequently, receptacles (16) are present on the frame backing (10) and vice versa. In one embodiment, the frame backing (10) has three apertures (14*a*). The side walls of the frame backing (10) comprise a plurality of calibration lines that facilitate positioning of multiple frame backings together in a pre-determined layout, which aids in putting up a display of multiple photographs. In one embodiment, the calibration lines are inch markings. In another embodiment, the calibration lines are centimeter markings.

Figure 4:
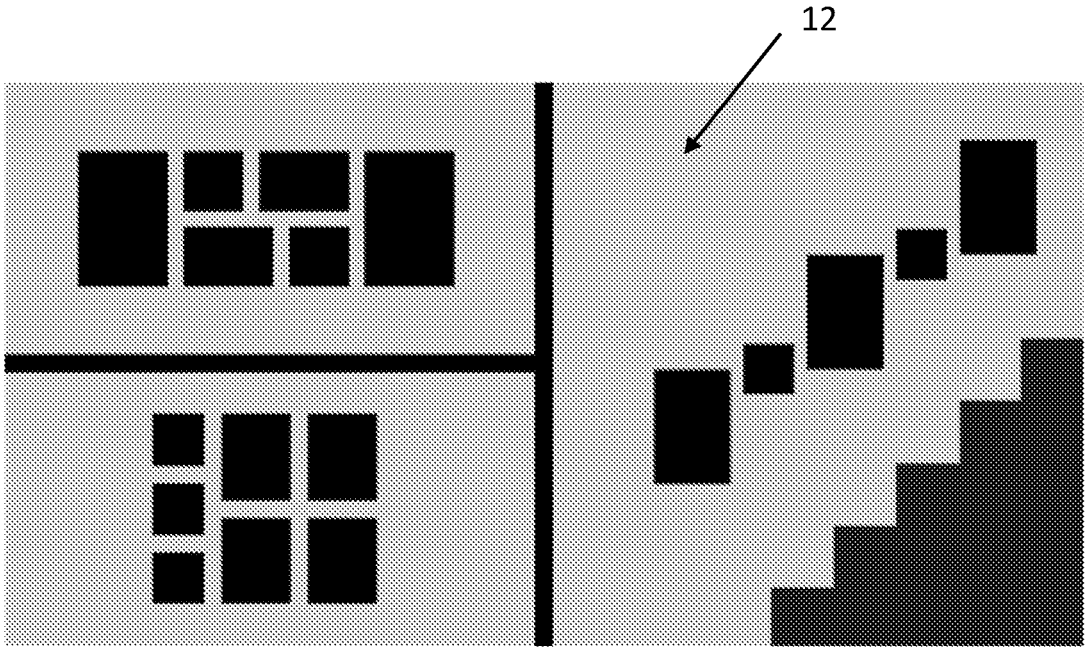
FIG. 4 illustrates non-limiting embodiments of photographs framed and displayed using the system (100) of the present disclosure.

The fastening mechanism (18) of the present disclosure is for affixing the frame backing (10) to the mounting surface (12). The fastening mechanism (18) comprises at least one couple fastener (18) such that a first member (18*a*) of the couple fastener is adapted to be reversibly affixed to the mounting surface (12) and a second member (18*b*) of the couple fastener (18) is adapted to be reversibly affixed to the back face (10*b*) of the frame backing (10) into the receptacle (16). The first (18*a*) and the second member (18*b*) of the couple fasteners are adapted to form a tight bond upon coming in close proximity with each other, thereby ensuring that the frame backing (10) is placed firmly onto the mounting surface (12). Both the first (18*a*) and second (18*b*) members have a strong adhesive on their back sides to ensure firm attachment to the mounting surface (12) and the frame member (10) respectively. The adhesive used herein can be any adhesive known in the art for similar purposes. In one embodiment, the adhesive is non-residue forming in nature; thereby ensuring that if the couple fasteners are to be permanently removed from the mounting surface, no residue is left behind. The shape and size of the loop member (18*b*) and the receptacle (16) should be the same. The first member (18*a*) is adapted to be affixed on the mounting surface (12) after appropriate markings are made on it based on the layout of the photo display (illustrated in FIG. 4). The first (18*a*) and second (18*b*) member of the couple fastener also comprises at least one aperture (14*b*) that is co-axial to the aperture(s) (14*a*) on the frame backing (10).

In one embodiment, the couple fastener (18) is a hook and loop system. The hook member (18*a*) is rougher and filled with very tiny hooks; whereas the loop member (18*b*) is less coarse with clusters of hairy loops. When the two members are pressed together, the hooks catch the loops and bind together, resulting in fastening and closure. In one embodiment, the hook member (18*a*) of the present disclosure is a hook dot and the loop member (18*b*) is a loop dot. In another embodiment, the couple fastener (18) is a pair of magnets.

The marking tool (20) of the present disclosure is adapted to pass through the apertures (14*a*) on the frame backing (10) and the couple fasteners (18) to create at least one marking on the mounting surface (12). At least one end of the marking tool (20) comprises at least one dye dispenser. The marking tool (20) enables the user to quickly and effortlessly mark the pre-determined positions of the frames on the go, thereby cutting short the complex and time consuming process of making markings typically associated with arranging and displaying photographs.

The frame bracket (22) of the present disclosure is adapted to reversibly plug into the side walls of the frame backing (10). The frame bracket (22), in one embodiment, is a one-piece light weight plastic moulded bracket. In another embodiment, the frame bracket (22) is made of nitrile rubber or NBR foam. The frame bracket (22) of the present disclosure can be of variable colours and shapes, giving the user the ability to change the bracket if desired, and effortlessly achieve a whole new look with same old frame backing (10).

Characteristically, the number of apertures (14*a*) and the number of receptacles (16) on the frame backing (10) exactly match the number of couple fasteners (18). Furthermore, the diameter of the aperture (14*a*) in the frame backing and the aperture (14*b*) in the couple fastener (18) matches exactly to enable the marking tool (20). This is to enable the marking tool (20) to pass through the components and reach the mounting surface (12) smoothly.

Figure 3:
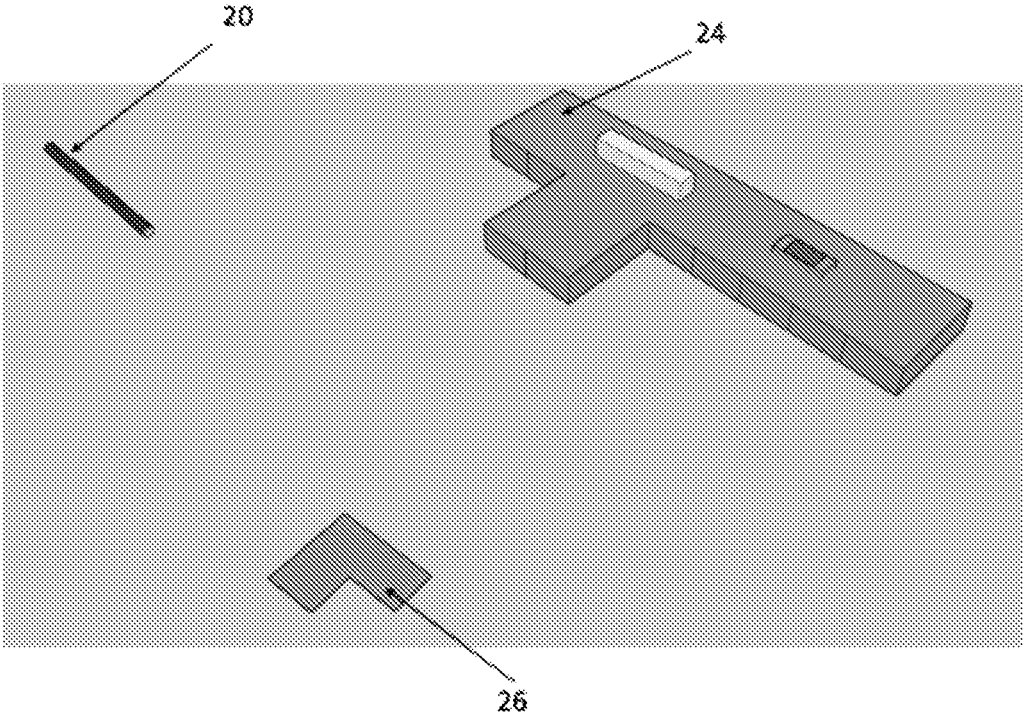
FIG. 3 illustrates non-limiting embodiments of the positioning tool (24), the sticky marker (26) and the marking tool (20) of the system (100) of the present disclosure.

The system (100) of the present disclosure also comprises at least one positioning tool (24) (illustrated in FIG. 3) to enable a user to efficiently stick photographs on the frame backing (10) and to align multiple frame backings together. In one embodiment, the positioning tool (24) is a one-piece plastic moulded compass. By placing the positioning tool (24) around the frame backing (10), the user can stick the photograph precisely without its edges going outside the frame backing (10). Furthermore, the positioning tool (24) facilitates multiple frame backings to be aligned in parallel or perpendicular manner on the mounting surface (12), without errors. The positioning tool (24) comprises at least one handle making it easy to hold and use; a spirit level, inch markings and two right angles, which enable the user to place multiple frame backings symmetrically.

The system of the present disclosure also comprises at least one sticky marker (26) to temporarily mark the exact position of the frame backing (10) on the mounting surface (12). The sticky marker (26) (illustrated in FIG. 3), in one embodiment, is an L-shaped sticky note which enables the user to remember the exact positioning of the frame backing (10) on the mounting surface (12), temporarily.

The present system (100) can be used for mounting photographs on any surface (12) including but not limited to walls.

The present disclosure further provides a kit (200) for framing and displaying photographs. The kit (200) comprises the components of the system (100) described herein above along with at least one housing member (28) for housing the afore-mentioned components. The kit (200) is envisaged to come handy in framing and displaying photographs and may include any other components that are typically associated with consumer kits.

The inventor of the present disclosure also provides a method for framing and displaying photographs using the present system (100), the steps of which are described herein after:

- deciding the layout of photographs using all the frame backings (10) (illustrated in FIG. 4);
- selecting the one frame backing (10) which will fall in the center of the layout, from all the frame backings (10). If there is more than one frame backing (10) in the center, select anyone of the two;
- positioning the frame backing (10) on the wall (12) as desired and posting two sticky markers (26) on the wall (12), along the bottom corners of frame backing;

making the markings with the marking tool (20) on the wall through apertures (14*a*) of the frame backing (10) while continuing to hold the frame backing (10) on the wall (12). Once the markings are complete, the frame backing (10) can be kept aside;

sticking four hook members (18*a*) on the wall (12) by aligning their apertures (14*b*) with the markings made in the previous step;

aligning one of the right angles of the positioning tool (24) with one corner of the frame backing (10);

peeling off the backing sheet of the frame backing (10);

pasting the photo whose corner is locked using the positioning tool (24). The positioning tool (24) edges ensure that the photograph does not move; thereby keeping the position intact and mounting impeccably (if air bubbles are formed while pasting the photo, use a clean cotton cloth and wipe the photo and push the bubbles to the nearest aperture of the frame backing (10) to release it);

placing the frame backing (10) back on to the wall (10) aligning with sticky marker (26) posted earlier. The loop member (18*b*) that is affixed in the receptacle (16) will lock in to the hook member (18*a*). Remove the sticky marker (26). The first frame is now fixed;

repeating the afore-mentioned steps for all the remaining frame backing (10) and aligning them as desired with the help of the positioning tool (24) and inch markings on the sides of the frame backing (10); and placing the frame brackets (22) on the layout once all the frame backings (10) are positioned on the wall (12), by putting the frame brackets (22) on respective frame backings (10).

The present system (100) eliminates the tedious process of taking complex measurements and hammering nails into the mounting surface (12). With the present system (100), users can simply make appropriate markings on the mounting surface (12) to place the photo frame, as desired. Additionally, the user also has the liberty to effortlessly place multiple frame backings (10) parallel or perpendicular to each other onto the mounting surface (124). Furthermore, this grouping of diverse sized pictures results in a well-designed symmetrically spaced layout, customized based on user preference and created without any professional help. Lastly, since the components of the present system (100) are light weight, there is no fear of frame(s) falling off accidently.

The embodiments described herein above are non-limiting. The foregoing descriptive matter is to be interpreted merely as an illustration of the concept of the present disclosure and it is in no way to be construed as a limitation. Description of terminologies, concepts and processes known to persons acquainted with technology has been avoided for the sake of brevity.

TECHNICAL ADVANTAGES AND ECONOMIC SIGNIFICANCE

The technical advantages and economic significance of the present system (100) include but are not limited to:

cost and time efficient;

reduces the dependability on skilled labour;

reduces the chances for human error;

reduces the damage to mounting surfaces;

compatible with multifarious frame shapes, sizes and weights enables users to frame photographs themselves in a professional manner; and doesn't limit the mounting surface to be wall only and can be placed on any flat surface.

I claim:

1. A system (100) for framing and displaying photographs comprising:

a. at least one frame backing (10) having a front face (10*a*) and a back face (10*b*) wherein said front face (10*a*) comprises at least one adhesive element to facilitate reversible attachment of at least one photograph thereon and said back face (10*b*) is adapted to be affixed to at least one mounting surface (12); said frame backing (10) comprising at least one aperture (14*a*) and at least one receptacle (16), wherein the at least one aperture (14*a*) is concentric to the at least one receptacle (16);

b. at least one fastening mechanism (18) for affixing said frame backing (10) to said mounting surface (12); said at least one fastening mechanism (18) comprising at least one couple fastener (18), wherein a first member (18*a*) of the at least one couple fastener (18) is adapted to be reversibly affixed to said mounting surface (12) and a second member (18*b*) of the at least one couple fastener (18) is adapted to be reversibly affixed to the back face (10*b*) of the frame backing (10) into the at least one receptacle (16) and wherein said first (18*a*) and second member (18*b*) of the at least one couple fastener comprises at least one aperture (14*b*) that is co-axial to the at least one aperture (14*a*) on the frame backing (10);

c. at least one marking tool (20) adapted to pass through the apertures on the frame backing (14*a*) and the at least one couple fastener (14*b*) to create at least one marking on the mounting surface (12); and d. at least one frame bracket (22) adapted to reversibly plug into meat least one side wall of said frame backing (10), wherein the number of the at least one aperture (14*a*) and the number of the at least one receptacle (16) on the frame backing (10) exactly match the number of the at least one couple fastener (18).

2. The system (100) as claimed in claim 1, wherein the number of the at least one aperture (14*a*) on the frame backing (10) depend on the size and shape of the frame backing (10).

3. The system (100) as claimed in claim 1, wherein the side walls of said frame backing (10) comprise a plurality of calibration lines that facilitate positioning of multiple frame backings together in a pre-determined layout.

4. The system (100) as claimed in claim 1, wherein the at least one couple fastener (18) is at least one selected from the group consisting of hook and loop fastener and magnets.

5. The system (100) as claimed in claim 1, wherein one end of the at least one marking tool (20) comprises at least one dye dispenser.

6. The system (100) as claimed in claim 1, further comprising at least one positioning tool (24) adapted to enable a user to efficiently stick photographs on the frame backing (10) and to align multiple frame backings together, said positioning tool comprising at least one handle, a spirit level, calibration lines and two right angles.

7. The system (100) as claimed in claim 1, further comprising at least one sticky marker (26) adapted to temporarily mark the exact position of the frame backing (10) on the mounting surface (12).

8. A kit (200) for framing and displaying photographs comprising:

a. at least one frame backing (10) having a front face (10*a*) and a back face (10*b*) wherein said front face (10*a*) comprises at least one adhesive element to facilitate reversible attachment of at least one photograph thereon and said back face (10*b*) is adapted to be affixed to at least one mounting surface (12); said frame backing (10) comprising at least one aperture (14) and at least one receptacle (16), wherein the at least one aperture (14*a*) is concentric to the at least one receptacle (16); and wherein heat least one side wall of said frame backing (10) comprises a plurality of calibration lines that facilitate positioning of multiple frame backings together in a pre-determined layout;

b. at least one fastening mechanism (18) for affixing said frame backing (10) to said mounting surface (12); the at least one fastening mechanism (18) comprising at least one couple fastener (18), wherein a first member (18*a*) of the at least one couple fastener (18) is adapted to be reversibly affixed to said mounting surface (12) and a second member (18*b*) of the at least one couple fastener (18) is adapted to be reversibly affixed to the back face (10*b*) of the frame backing (10) into the at least one receptacle (16) and wherein said first (18*a*) and second member (18*b*) of the at least one couple fastener comprises at least one aperture (14*b*) that is co-axial to the at least one aperture (14*a*) on the frame backing (10);

c. at least one marking tool (20) adapted to pass through the at least one aperture on the frame backing (14*a*) and the at least one couple fastener (14*b*) and comprising one end having at least one dye dispenser to create at least one marking on the mounting surface (12);

d. at least one frame bracket (22) adapted to reversibly plug into the side walls of said frame backing (10); and e. at least one housing member (28) for housing components a-d, wherein the number of the at least one aperture (14*a*) and the number of the at least one receptacle (16) on the frame backing (10) exactly match the number of the at least one couple fastener (18).

9. The kit (200) as claimed in claim 8, wherein the number of the at least one aperture (14*a*) on the frame backing (10) depends on the size and shape of the frame backing (10).

10. The kit (200) as claimed in claim 8, wherein the at least one couple fastener (18) is at least one selected from the group consisting of hook and loop fastener and magnets.

11. The kit (200) as claimed in claim 8, further comprising at least one positioning tool (24) adapted to enable a user to efficiently stick photographs on the frame backing (10) and to align multiple frame backings together, said positioning tool comprising at least one handle, a spirit level, calibration lines and two right angles.

12. The kit (200) as claimed in claim 8, further comprising at least one sticky marker (26) adapted to temporarily mark the exact position of the frame backing (10) on the mounting surface (12).

* * * * *